United States Patent [19]

Love et al.

[11] Patent Number: 4,765,918

[45] Date of Patent: Aug. 23, 1988

[54] LUBRICANT ADDITIVE

[75] Inventors: Doris Love; Raymond C. Schlicht, both of Fishkill; Joseph B. Biasotti, Lagrangeville, all of N.Y.

[73] Assignee: Texaco Inc., White Plains, N.Y.

[21] Appl. No.: 935,861

[22] Filed: Nov. 28, 1986

[51] Int. Cl.[4] ..... C01M 149/12; C01M 151/04

[52] U.S. Cl. ..... 252/46.4; 252/42.7; 252/47.5; 252/400.54; 260/402.5

[58] Field of Search ..... 252/46.4; 260/402.5

[56] References Cited

U.S. PATENT DOCUMENTS

| | | | |
|---|---|---|---|
| 3,405,064 | 10/1968 | Miller | 252/51.5 A |
| 4,259,194 | 3/1981 | deVries et al. | 252/46.4 |
| 4,263,152 | 4/1981 | King et al. | 252/46.4 |
| 4,265,773 | 5/1981 | deVries et al. | 252/46.4 |
| 4,272,387 | 6/1981 | King et al. | 252/46.4 |
| 4,283,295 | 8/1981 | deVries et al. | 252/46.4 |
| 4,285,822 | 8/1981 | deVries et al. | 252/46.4 |
| 4,315,826 | 2/1982 | Schlicht et al. | 252/46.4 |
| 4,362,633 | 12/1982 | Spence et al. | 252/46.4 |
| 4,369,119 | 1/1983 | deVries et al. | 252/46.4 |
| 4,370,246 | 1/1983 | deVries et al. | 252/46.4 |
| 4,394,279 | 7/1983 | deVries et al. | 252/46.4 |
| 4,395,343 | 7/1983 | deVries et al. | 252/42.7 |
| 4,402,840 | 9/1983 | deVries et al. | 252/46.4 |
| 4,466,901 | 8/1984 | Hunt et al. | 252/42.7 |
| 4,500,439 | 2/1985 | West et al. | 252/46.4 |
| 4,620,855 | 11/1986 | Higgins | 252/46.4 |

*Primary Examiner*—William R. Dixon, Jr.
*Assistant Examiner*—Ellen McAvoy
*Attorney, Agent, or Firm*—Robert A. Kulason; James J. O'Loughlin; Robert B. Burns

[57] ABSTRACT

A lubricating oil additive is prepared by reacting a triglyceride with a basic nitrogen compound to form a reaction product, reacting said reaction product with an acidic molybdenum compound to form an intermediate reaction product, and reacting said intermediate reaction product with a sulfur compound to produce a lubricating oil additive.

13 Claims, No Drawings

LUBRICANT ADDITIVE

FIELD OF THE INVENTION

This invention relates to a novel lubricating oil additive having friction modifying and antioxidant properties and to a lubricating oil composition containing the novel additive. More specifically, this application relates to a novel additive reaction product prepared in a series of reactions between a triglyceride and a basic nitrogen compound, followed by a reaction with a molybdenum compound, and finally a reaction with a sulfur compound to produce a molybdenum and sulfur-containing reaction product.

BACKGROUND OF THE INVENTION

Molybdenum compounds are known to be useful as friction modifiers in lubricating oil compositions. However, many molybdenum compounds exhibit poor solubility in lubricating oils. Molybdenum disulfide, a commonly used lubricant additive, has poor solubility in oil and various methods including fine grinding and dispersing agents have been employed to improve its effectiveness in lubricating oils.

A number of alternative approaches have been proposed for the incorporation of molybdenum in lubricating oils. In general, these approaches involve preparing complex reaction products containing molybdenum which exhibit improved solubility of the molybdenum-containing complex in lubricating oils.

DISCLOSURE STATEMENT

U.S. Pat. No. 4,263,152 discloses an oil-soluble, sulfur-containing molybdenum complex prepared by reacting an acidic molybdenum compound, a basic nitrogen composition and a sulfur compound to form a molybdenum-sulfur containing complex useful for inhibiting oxidation and imparting anti-wear properties and/or modifying friction properties of a lubricating oil.

U.S. Pat. No. 4,370,246 discloses the use of an oil-soluble, sulfur-containing molybdenum complex prepared by reacting an acidic molybdenum compound, a basic nitrogen compound and a sulfur compound in combination with an oil-soluble aromatic amine compound. The disclosure of this reference is incorporated herein by reference.

SUMMARY OF THE INVENTION

A novel lubricating oil additive has been discovered which is effective as a friction modifier and as a stabilizing or anti-oxidant agent in a lubricating oil composition. The novel lubricating oil additive of the invention is a complex reaction product prepared in a series of reactions. A triglyceride is reacted with a basic nitrogen compound forming a reaction product. This reaction product is reacted with a molybdenum compound to produce a molybdenum-containing second reaction product and the second reaction product is reacted with a sulfur compound to produce a molybdenum-containing, sulfur-containing reaction product effective as a lubricant additive.

DETAILED DESCRIPTION OF THE INVENTION

The initial step in preparing the reaction product of the invention is a reaction between a triglyceride and a basic nitrogen compound. The triglyceride and the basic nitrogen compound are reacted using a mole ratio of said triglyceride to said basic nitrogen compound in the range from about 2:1 to 1:3 respectively. These reactants are reacted in an inert atmosphere as, for example, under a blanket of nitrogen accompanied by the blowing of an inert gas through the reaction mixture to remove any water formed during the reaction overhead.

The triglyceride reactant useful for preparing lubricant additive of the invention is represented by the formula:

$$\begin{array}{l} H_2-C-O_2C-R \\ \quad\;\; | \\ H-C-O_2C-R' \\ \quad\;\; | \\ H_2-C-O_2C-R'' \end{array}$$

in which R, R',R'' represent aliphatic hydrocarbon radicals having from 7 to 21 carbon atoms. The aliphatic hydrocarbon radicals may be saturated or unsaturated or a mixture of both saturated and unsaturated radicals. The preferred triglycerides are those in which the aliphatic radicals represented by R, R' and R'' have from about 11 to 17 carbon atoms. Typical triglycerides employed for preparing the reaction product of the invention include coconut oil, safflower oil, sunflower oil, cottonseed oil, peanut oil, corn oil, castor oil, soybean oil, palm oil, sesame oil as well as animal oils and fats having the prescribed structural formula, such as lard oil and tallow.

The basic nitrogen compound is one having a basic nitrogen content as measured by ASTM D-664 or D-2896 and is preferably oil-soluble. Typical basic nitrogen compounds include hydrocarbon polyamines, succinimides and carboxylic acid amides.

The preferred basic nitrogen compounds are the polyalkylene polyamines. Polyalkylene polyamines are represented by the formula:

$$H_2N\,(-CH_2-CHR-\overset{\overset{\displaystyle H}{|}}{N}-)_x\,H$$

in which R is hydrogen or a methyl radical and x has a value from 1 to 10.

The preferred polyalkylene polyamines are represented by the formula above in which x has a value from 2 to 6. Specific polyalkylene polyamines within the prescribed formula include diethylenetriamine, triethylenetetramine, tetraethylenepentamine and pentaethylenehexamine.

The triglyceride and the basic nitrogen compound are reacted employing mole ratios of the triglyceride to the basic nitrogen compound in the range from about 2:1 to 1:3 respectively, with a preferred ratio being about 1:1. The reaction is conducted under an inert atmosphere at a temperature ranging from about 100° C. up to the decomposition temperature of the reactants. In general, the reaction will be conducted at a temperature ranging between about 120° to 200° C. with the preferred reaction temperature being in the range of 120° to 160° C. It is preferable to pass a stream of an inert gas through the reaction mixture during the reaction to effect the removal of any water formed in the reaction. In general, nitrogen is the inert gas of choice for blanketing and for the inert gas stream during the reaction. A preferred rate of gas flow through the reaction mixture is from about 25 to 200 milliliters of inert gas per minute, per liter of reactants. For the quantities of reactants employed in the following example, the noted reaction conditions were maintained for about five hours in order to produce the first reaction product leading to the preparation of the lubricant additive. It is postulated that this first reaction product comprises a mixture of fatty amides and glycerin partial esters.

An intermediate or reaction product is prepared by reacting the first reaction product with a molybdenum compound under reaction conditions similar to those employed in the first reaction. The molybdenum compounds which can be employed are acidic molybdenum compounds, that is, molybdenum compounds which will react with a basic nitrogen compound measured by the ASTM tests noted above. Particularly suitable molybdenum compounds include molybdic acid, ammonium molybdate, and molybdenum salts such as $MoOCl_4$, $MoO_2Br_2$, $Mo_2O_3Cl_6$ and molybdenum trioxide.

The first reaction product and the prescribed molybdenum compound are reacted employing a mole ratio of said first reaction product and said molybdenum compound in the range of 2:1 to 1:3 respectively. This reaction is conducted at a temperature ranging from about 100° to 200° C. with the preferred reaction temperature being from about 120° to 160° C. This reaction is conducted under an inert atmosphere using a sweep of an inert gas, such as nitrogen. A suitable gas flow rate is from about 25 to 200 milliliters of nitrogen per minute per liter of the reaction mixture.

In the final step of the additive preparation, the intermediate reaction product is reacted with a sulfur-containing compound. Sulfur-containing compounds which can be employed include sulfur, hydrogen sulfide, sulfurized olefins having from 3 to 18 carbon atoms, ammonium sulfides and polysulfides.

The intermediate reaction product and the sulfur compound are reacted employing a mole ratio of said intermediate reaction product, based on molybdenum, and said sulfur compound in the range from about 1:1 to 1:4 respectively with the preferred mole ratio being from about 1 to 2. This reaction is conducted under an inert atmosphere with a sweep of an inert gas through the reaction mixture. The temperature of the reaction may range from about 100° to 200° C. with a preferred reaction temperature being from about 120° to 160° C. The reaction conditions are maintained for sufficient time to produce or yield the molybdenum-containing, sulfur-containing reaction product and lubricant additive of the invention.

Another potential starting material is a sulfurized triglyceride; in which case, sulfurization after the molybdenum step may not be required.

In general, the lubricant additive of the invention will be characterized by having the following analytical composition, a nitrogen content from about 1 to 4 weight percent, molybdenum content from about 2 to 6 weight percent and a sulfur content ranging from about 1 to 4 weight percent.

The following Examples illustrate the preparation of the novel reaction product of this invention.

EXAMPLE 1

1344 grams (2.0 moles) of coconut oil and 206 grams (2.0 moles) of diethylenetriamine were combined in the reactor equipped with a stirrer, thermocouple, thermometer gas inlet tube and a Dean-Stark water trap. This mixture was heated to 120° C. under a blanket of nitrogen. A nitrogen sweep was commenced at the rate of 100 milliliters of nitrogen per minute. Reaction conditions were maintained for about five hours followed by filtering and recovery of a reaction product. This initial product was analyzed and found to contain 5.7 weight percent nitrogen vs. 5.4 weight percent nitrogen in theory.

194 grams (0.25 mole) of the above reaction product, 36.0 grams (0.25 moles) of molybdenum trioxide and 236 grams of a pale stock mineral oil were combined in a reactor similar to the above. This mixture was heated to about 150° C. under nitrogen and a nitrogen sweep was started at the rate of 100 milliliters of nitrogen per minute. The reaction was continued under the noted conditions with stirring for about 1 hour after which it was filtered and found to yield 447 grams of a very dark, viscous reaction product. This intermediate or second reaction product was analyzed and found to contain 2.1% weight percent nitrogen, 5.0% weight percent of molybdenum and to have a kinematic viscosity at 100° C. of 34.5 centistokes.

235 grams (0.125 mole) of the intermediate reaction product and 8 grams (0.25 moles) of sulfur were combined in a reactor equipped similar to the above. This mixture was heated to 150° C. under a nitrogen blanket and a stream of nitrogen was passed through the reaction mixture at a rate of 50 milliliters of nitrogen per minute. These reaction conditions were maintained for about 3 hours to completion. This reaction product was filtered, separating 2.0 grams of precipitate and yielding 222 grams of a very dark, final reaction product which was a solid at room temperature. Analysis of the final reaction product found the following:

| | Weight Percent |
|---|---|
| Nitrogen | 2.6 |
| Molybdenum | 4.8 |
| Sulfur | 2.8 |

EXAMPLE 2)

739 grams (0.83 moles) of safflower oil and 90 grams (0.83 moles) of diethylenetriamine were mixed and reacted as described in Example 1. The reaction was conducted at about 120° C. under a nitrogen atmosphere and a stream of nitrogen for five hours. Approximately 0.6 milliliter of water was collected overhead. A yield of 793 grams of a filtered product was obtained which is bright and clear hot, but solid at room temperature. The product analyzed 4.5 weight percent nitrogen.

247 grams (0.25 moles) of the above reaction product, 36.0 grams (0.25 moles) of molybdenum trioxide and 283 grams of a pale stock mineral oil were combined were heated to 150° C. under a nitrogen atmosphere and reacted at 150° C. for about one hour while a stream of nitrogen was passed through the reaction mixture. Three grams of precipitate were removed by filtration giving a yield of 539 grams of a dark, somewhat viscous reaction product. Analysis of this reaction product found that it contained 1.9 weight percent nitrogen, and 3.8 weight percent molybdenum. Its kinematic viscosity at 100° C. was 17.1 centistokes.

283 grams (0.125 moles) of the intermediate reaction product and 8 grams (0.25 moles) of sulfur were mixed and reacted as in Example 1. The mixture was heated to 150° C. under an atmosphere of nitrogen. The reaction was conducted with stirring at 150° C. for about three hours while a stream of nitrogen passed through the reaction mixture. The reaction product was filtered removing 0.2 grams of precipitate giving 271 grams of a very dark final reaction product. Analysis of this reaction product found the following:

| | Weight Percent |
|---|---|
| Nitrogen | 1.8 |
| Molybdenum | 3.8 |
| Sulfur | 2.5 |

Its kinematic viscosity at 100° C. was 45.3 centistokes.

EXAMPLE 3

886 grams (1.0 moles) of sunflower oil and 108 grams (1.0 moles) of diethylenetriamine (95%) were mixed and reacted as in Example 1 above. The mixture was heated to 125° C. under a nitrogen atmosphere. The reaction was conducted at 120° C. for five hours while a stream of nitrogen was passed through the reaction mixture and with the collection of any water overhead. 965 grams of filtered product were obtained which was bright and clear, hot and a waxy solid at room temperature. This reaction product was found to contain 4.3 weight percent nitrogen.

247 grams (0.25 moles) of the above reaction product, 36.0 grams (0.25 moles) of molybdenum trioxide and 283 grams of pale stock mineral oil were mixed and heated to about 150° C. under a nitrogen atmosphere. The reaction was maintained at 150° C. for one hour while a stream of nitrogen was passed through the reaction product. The reaction product was filtered removing 4.7 grams of a precipitate and yielding 543 grams of a dark slightly viscous product. Analysis found this product to contain 1.9 weight percent nitrogen, and 3.7 weight percent of molybdenum. Viscous kinetic viscosity of 100° C. was 16.8 centistokes.

283 grams (0.125 moles) of the intermediate reaction product above and 8 grams (0.25 moles) of sulfur were mixed in a manner described above and the mixture heated to 150° C. under a blanket of nitrogen. The reaction of this mixture was effected at 150° C. with stirring for three hours while a stream of nitrogen was passed through the reaction mixture. A trace of water was separated out of the reaction mixture. The product was filtered separating 0.5 grams of precipitate to yield 267 grams of a very dark final reaction product. Analysis of this final reaction product found the following:

| | Weight Percent |
|---|---|
| Nitrogen | 1.8 |
| Molybdenum | 3.6 |
| Sulfur | 2.5 |

EXAMPLE 4

222 grams (0.25 moles) of sunflower oil and 27 grams (0.25 moles) of diethylenetriamine (95%) were mixed and reacted as in Example 1 above. The mixture was heated to 120° C. under a nitrogen atmosphere and the reaction continued with stirring at 120° C. for five hours while a stream of nitrogen (100 ml/min/liter of reaction mixture) was passed through the reaction mixture. Approximately 0.1 milliliter of water was collected overhead.

36.0 grams (0.25 moles) of molybdenum trioxide and 283 grams of pale stock mineral oil were mixed with the reaction product above and the entire mixture was heated to about 150° C. under a nitrogen atmosphere. The reaction was maintained at 150° C. for one hour while a stream of nitrogen was passed through the reaction product. A trace of water was collected overhead during the preparation of this intermediate reaction product.

The intermediate reaction product prepared above and 16 grams (0.5 moles) of sulfur were mixed in a manner described above and the mixture heated to 150° C. under a blanket of nitrogen. The reaction of this mixture was effected at 150° C. with stirring for three hours while a stream of nitrogen was passed through the reaction mixture. A small amount (1.1 ml) of water was collected during this reaction. The final reaction product was filtered separating 4.5 grams of precipitate and yielding 547 grams of a very dark viscous final reaction product. Analysis of this final reaction product found the following:

| | Weight Percent |
|---|---|
| Nitrogen | 2.2 |
| Molybdenum | 3.9 |
| Sulfur | 2.7 |

EXAMPLE 5

222 grams (0.25 moles) of corn oil and 27 grams (0.25 moles) of diethylenetriamine are combined in a flask and heated to 120° C. under a nitrogen atmosphere. The reaction conditions were maintained for about 5 hours during which time about 0.1 milliliters of water was collected.

36 grams (0.25 moles) of molybdenum trioxide and 283 grams of pale mineral oil were added to the reaction product above and this mixture was heated to 150° C. This reaction was continued for about 1 hour with stirring to produce an intermediate reaction product. Approximately 0.2 milliliters of water were collected overhead.

16 grams (1.0 moles) of sulfur were added to the intermediate reaction product above and this mixture was reacted at 150° C. under a nitrogen atmosphere for about 3 hours. 2.6 milliliters of water were collected overhead. The reaction product was filtered separating off 1.8 grams of precipitate yielding 533 grams of the reaction product. Analysis of the reaction product gave the following results:

| Nitrogen | MO | Sulfur |
|---|---|---|
| 1.7% | 3.7% | 2.5% |

Kinematic viscosity at 100° C. = 44.4 centistokes.

EXAMPLE 6

219 grams (0.25 moles) of peanut oil and 27 grams (0.25 moles) diethylenetriamine were mixed and reacted at 120° C. under nitrogen following the procedures described above. After 5 hours a trace of water was collected overhead.

36 grams (0.25) of molybdenum trioxide and 278 grams of pale mineral oil were added to the mixture above and this mixture was heated to about 150° C. and reacted for about 1 hour. Approximately 0.1 mole milliliter of water was collected overhead.

16 grams (1.0 mole) of sulfur was added to the reaction product above and this mixture was reacted at about 150° C. under nitrogen for 3 hours. 2.5 milliliters of water were collected. The reaction product was filtered separating 2.4 grams of precipitate to give a yield of 544 grams of the reaction product. Analysis of this reaction product gave the following values:

| Nitrogen | Mo | % Sulfur | Kinematic Viscosity at 100° C. |
|---|---|---|---|
| 1.9% | 3.75 | 2.54 | 51.8 Centistokes |

EXAMPLE 7

443 grams (0.5 moles) of sunflower oil and 95 grams (0.5 moles) of tetraethylenepentamine are combined in the flask and the mixture heated to 120° C. under nitrogen. This reaction was continued under these conditions with stirring for about 5 hours. The product was filtered a giving yield of 507 grams of filtered product having the following analysis:

Percent nitrogen=6.0

Total Base Number=117.6

270 grams (0.25 moles) of the above reaction product, 36 grams (0.25 moles) of molybdenum trioxide and 313 grams of pale mineral oil were combined in a flask. This mixture was heated to 150° C. and the reaction conditions were continued under nitrogen and with stirring for about 1 hour. No water was collected overhead.

The reaction product obtained above was cooled to about 120° C. and 16 grams (0.5 moles) of sulfur were added. The sulfur containing mixture was heated to 150° C. and reacted at this temperature under nitrogen with stirring for about 3 hours. 0.5 milliliters of water were collected. The reaction product was filtered and a yield of 573 grams was obtained. Analysis gave the following values.

| % Nitrogen | % Sulfur | % Molybdenum |
|---|---|---|
| 2.5 | 2.4 | 3.7 |

Kinematic viscosity @ 100° C. = 44.2 centistokes.

EXAMPLE 8

443 grams (0.5 moles) of sunflower oil and 116 grams (0.5 moles) of pentaethylenehexamine were mixed and reacted at about 120° C. under nitrogen with stirring for about 5 hours as described in the previous example. The reaction product was filtered to yield 539 grams of reaction product having the following values:

| % Nitrogen | TBN |
|---|---|
| 6.9 | 149 |

280 grms (0.25 moles) of the above reaction product, 36 grams (0.25 moles) of molybdenum trioxide and 320 grams of a pale mineral oil were mixed and the mixture was heated to about 150° C. Reaction was continued at this temperature under nitrogen and with stirring for about 1 hours. No water was collected overhead.

The above reaction product was cooled to 120° C. and 16 grams (0.5 moles) of sulfur were added. The sulfur containing mixture was heated to about 150° C. and reacted at this temperature under nitrogen with stirring for about 3 hours. 0.4 milliliters of water were collected overhead. The reaction product was filtered to yield 605 grams of reaction product having the following values:

| % Nitrogen | % Sulfur | % Molybdenum |
|---|---|---|
| 3.0 | 2.4 | 3.6 |

Kinematic viscosity @ 100° C. - 48.5 centistokes.

The effectiveness of the novel lubricant additive of the invention as a friction modifier for a lubricating oil was demonstrated in runs made using the Small Engine Friction Test (SEFT). The Small Engine Friction Test uses a single cylinder, air-cooled, 6-horsepower engine driven by an electric motor. The engine has a cast-iron block and is fitted with an aluminum piston and chrome-plated rings. The electric motor is cradle-mounted so that the reaction torque can be measured by a strain arm. The engine is housed in a thermally insulated enclosure with an electric heater and is driven at 2000 rpm.

Prior to each test run, the engine is flushed three times with 1-quart charges of test oil. During the test run, the engine and oil temperatures are increased continually from ambient until a 280° F. oil temperature is reached. The heat is produced by engine friction, air compression work and from an electric heater. The engine and oil temperatures and the engine motoring torque are recorded continually during the 4 hour test. Each test oil evaluation is preceded by a run on a reference oil for a like period of time. The torque reference level for the engine shifts slightly with time as a result of engine wear. For accurate evaluation, the test oil results are recorded compared to a reference band consisting of data from up to three reference runs made before and three runs made after the test oil evaluation.

The base oil used in this test was a fully formulated 10W-40 commercial lubricating oil composition containing no friction modifier. A second comparison oil was a modified base oil, i.e. a fully formulated 10W-40 commercial lubricating oil composition containing a known friction modifier. The lubricant additive of the invention was tested in a fully formulated 10W-40 commercial lubricating oil corresponding to the base oil.

The results obtained in the Small Engine Friction Test are given in the Table I below:

TABLE I

SMALL ENGINE FRICTION TEST

| Lubricant Composition | Torque, Ft. Lbs. (138° C.) |
|---|---|
| Run 1. Commercial 10W-40 motor oil (No friction modifying additive) | 2.63 |
| Run 2. Commercial 10W-40 motor oil containing a known friction modifier | 2.44 |
| Run 3. 10W-40 Base Oil containing Example 2 friction modifier(1) | 2.41 |
| Run 4. 10W-40 Base Oil containing Example 3 friction modifier(1) | 2.44 |

(1)The concentration of the friction modifier was at 58 weight percent of the concentration of the friction modifier used in Run 2.

The foregoing tests demonstrate the effectiveness of the lubricating oil additive of the invention as a friction modifier against a commercial friction modifier.

The effectiveness of the additive of the invention was also determined in the ASTM Fuel Efficiency Engine Oil (FEEO) Dynamometer Test. In the test results, a fully formulated 5W-30 oil composition containing a known friction modifier and a friction modifier of the invention were compared. A performance result of at least +2.75 is required in order to pass second-tier requirements of this test. The results are shown in Table II below.

TABLE II

| ASTM FEEO DYNAMOMETER TEST Equivalent 5-Car Fuel Economy | | | |
|---|---|---|---|
| Run | Friction Modifier | Concentration of Active Ingredient | Modified 5W-30 Oil Concentration Formulation |
| 1. | Example 4 Friction Modifier | 0.52 (w) % | +2.90 |
| 2. | Known Friction Modifier | 0.50 (w) % | +2.46<br>+2.65 check |

The results clearly show on improvement in fuel efficiency obtained using the friction modifier of the invention.

The novel additive of the invention was tested for its oxidation inhibiting properties when employed in an oil composition of lubricating viscosity. The oxidation stability was determined in the Bench Oxidation Test. In this test, the oil composition is heated to 175° C. under a nitrogen blanket. A sample is taken to establish a base line. The oil is maintained at 175° C. while a stream of air is passed through it at the rate of 500 ml/minute for six hours. Samples are taken every hour and the DIR of each sample is determined against the base line at 1712 $CM^{-1}$. The six-hour DIR is used as a measure of oxidation; the smaller the value, the better the antioxidant properties.

In these tests, the oil employed was a solvent neutral oil having an SUS viscosity at 100° F. of 130. This oil was mixed with an overbased sulfonate to give a base oil composition containing 0.18 weight percent calcium. In the tested oils, the antioxidant additive was employed at a concentration of 0.5 weight percent. The results are set forth in Table III below:

TABLE III

| BENCH OXIDATION TEST | | |
|---|---|---|
| Run | | Six-Hour DIR |
| 1 | Base Oil (no antioxidant additive) | 19.1 |
| 2 | Base Oil + Commercial antioxidant | 14.8 |
| 3 | Base Oil + Example 1 | 12.3 |
| 4 | Base Oil + Example 4 | 4.5 |
| 5 | Base Oil + Example 3 | 4.0 |
| 6 | Base Oil + Example 2 | 4.5 |

The examples in Table III illustrate the surprising effectiveness of the novel lubricant additive of the invention as an antioxidant additive when employed in a lubricating oil composition.

We claim:

1. A lubricant additive prepared by reacting a triglyceride with a basic nitrogen compound employing a mole ratio of said triglyceride to said basic nitrogen compound in the range from about 2:1 to 1:3 respectively to produce a reaction product, reacting said reaction product with a acidic molybdenum compound employing a mole ratio of said reaction product to said molybdenum compound in the range from about 2:1 to 1:3 respectively to produce a second reaction product, and reacting said second reaction product with a sulfur compound employing a mole ratio of said second reaction product, based on molybdenum, to said sulfur in the range from about 1:1 to 1:4 respectively to produce said lubricant additive.

2. A lubricant additive according to claim 1 at which said triglyceride is represented by the formula:

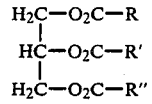

in which R, R' and R'' represent aliphatic hydrocarbon radicals having from about 7 to 21 carbon atoms.

3. A lubricant additive according to claim 1 in which said reactions are conducted at a temperature above 100° C. under an inert atmosphere.

4. A lubricant additive according to claim 1 in which said reaction steps are conducted at a temperature in the range from about 120° to 200° C.

5. A lubricant additive according to claim 1 in which said triglyceride is selected from the group consisting of coconut oil, safflower oil, sunflower oil, cottonseed oil, peanut oil, corn oil, castor oil, soybean oil, palm oil, sesame oil, animal oils and fats such as lard oil and tallow.

6. A lubricant additive according to claim 1 in which said acidic molybdenum compound is selected from the group consisting of molybdenum trioxide, molybdic acid and ammonium molybdate.

7. A lubricant additive according to claim 1 which said reaction steps are conducted under a nitrogen atmosphere while a stream of nitrogen is passed through the reaction mixtures at a rate ranging from about 25 to 200 milliliters per minute per liter of reaction mixture.

8. A lubricant composition prepared by reacting sunflower oil with diethylenetriamine at a temperature in the range of 125° to 175° C. under an inert atmosphere employing a mole ratio of said sunflower oil to said diethylenetriamine of about 1:1 to produce a reaction product, reacting said reaction product with molybdenum trioxide at a temperature at a range of 125° to 175° C. under an inert atmosphere employing a mole ratio of said reaction product to said molybdenum trioxide of about 1:1 to produce a second reaction product, and reacting said second reaction product with sulfur at a temperature at a range of 125° to 175° C. under an inert atmosphere employing a mole ratio of said second reaction product to said sulfur ranging from about 1 to 2 respectively to produce said lubricant additive.

9. A lubricant additive according to claim 1 containing from about 1 to 4 weight percent nitrogen, from about 2 to 6 weight percent molybdenum and from about 1 to 4 weight percent sulfur.

10. A lubricant additive according to claim 1, in which the basic nitrogen compound is selected from the group consisting of polyalkylene polyamines, succinimides and carboxylic acid amides.

11. A lubricant additive according to claim 10 in which the polyalkylene polyamines are diethylenetriamine, triethylenetetramine, tetraethylenepentamine, and pentaethylenehexamine.

12. A lubricant additive according to claim 1 in which the sulfur compound is selected from elemental sulfur, sulfurized olefins, hydrogen sulfide and ammonium sulfides and polysulfides.

13. A lubricant additive prepared by reacting a triglyceride with a polyalkyene polyamine compound employing a mole ratio of triglyceride to polyalkylene polyamine in the range from about 2:1 to 1:3 respectively to produce a first reaction product, reacting said first reaction product with an acidic molybdenum compound employing a mole ratio of said first reaction product to said molybdenum compound in the range from about 2:1 to 1:3 respectively to produce a second reaction product, and reacting said second reaction product with a sulfur compound employing a mole ratio of said second reaction product based on molybdenum to said sulfur in the range from about 1:1 to 1:4 respectively to produce said lubricant additive, said polyalkylene polyamine compound being represented by the formula:

$$H_2N\,(-CH_2-CHR-\overset{\overset{\displaystyle H}{|}}{N}-)_x\,H$$

in which R is hydrogen or a methyl radical and x has a value from 1 to 10.

* * * * *